US011490207B2

(12) United States Patent
Ruan

(10) Patent No.: US 11,490,207 B2
(45) Date of Patent: Nov. 1, 2022

(54) SOUND EMITTING STRUCTURE AND TERMINAL

(71) Applicant: VIVO MOBILE COMMUNICATION CO., LTD., Chang'an Dongguan (CN)

(72) Inventor: Qingbo Ruan, Chang'an Dongguan (CN)

(73) Assignee: VIVO MOBILE COMMUNICATION CO., LTD., Chang'an Dongguan (CN)

( * ) Notice: Subject to any disclaimer, the term of this patent is extended or adjusted under 35 U.S.C. 154(b) by 0 days.

(21) Appl. No.: 17/158,780

(22) Filed: Jan. 26, 2021

(65) Prior Publication Data

US 2021/0152944 A1 May 20, 2021

Related U.S. Application Data

(63) Continuation of application No. PCT/CN2019/096734, filed on Jul. 19, 2019.

(30) Foreign Application Priority Data

Jul. 26, 2018 (CN) ..... 201810834802.0

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01); *H04R 2499/15* (2013.01)

(58) Field of Classification Search
CPC ..... H04R 9/06; H04R 9/025; H04R 1/2834; H04R 1/347; H04R 2499/11; H04R 2400/11; H04R 2499/15
(Continued)

(56) References Cited

U.S. PATENT DOCUMENTS 4,207,430 A * 6/1980 Harada ..... H04R 3/002 381/59
8,879,774 B2 11/2014 Stead
(Continued)

FOREIGN PATENT DOCUMENTS

CN 101262713 A 9/2008
CN 102137320 A 7/2011
(Continued)

OTHER PUBLICATIONS

International Search Report & Written Opinion related to Application No. PCT/CN2019/096734; dated Feb. 4, 2021.
(Continued)

*Primary Examiner* — Alexander Krzystan
*Assistant Examiner* — Julie X Dang
(74) *Attorney, Agent, or Firm* — von Briesen & Roper, s.c.

(57) ABSTRACT

Provided are a sounding structure and a terminal. The sounding structure comprises: a frame comprising an accommodation cavity, the accommodation cavity comprising a first opening and a second opening provided on two opposite sides of the frame; a magnetic circuit system arranged in the accommodation cavity and comprising a first channel and a second channel; a first vibrating diaphragm arranged to face the first opening and provided with a voice coil, the voice coil partially extending into the first channel; and a second vibrating diaphragm arranged to face the second opening, the second channel communicating the first opening with the second opening.

8 Claims, 1 Drawing Sheet

(58) Field of Classification Search
USPC ..... 381/400–412
See application file for complete search history.

(56) References Cited

U.S. PATENT DOCUMENTS

| | | | | |
|---|---|---|---|---|
| 2006/0120551 | A1* | 6/2006 | Enomoto | H04R 9/025 381/396 |
| 2010/0018318 | A1* | 1/2010 | Watanabe | G01L 19/02 73/715 |
| 2013/0195293 | A1* | 8/2013 | Ko | H04R 1/24 381/191 |
| 2015/0181346 | A1* | 6/2015 | Jingming | H04R 1/342 381/114 |
| 2017/0171664 | A1 | 6/2017 | Shao et al. | |
| 2018/0206030 | A1 | 7/2018 | Cross et al. | |
| 2021/0152944 | A1 | 5/2021 | Ruan | |

FOREIGN PATENT DOCUMENTS

| | | | |
|---|---|---|---|
| CN | 205051866 | U * | 2/2016 |
| CN | 205051866 | U | 2/2016 |
| CN | 105430577 | A | 3/2016 |
| CN | 205336520 | U | 6/2016 |
| CN | 205726386 | U | 11/2016 |
| CN | 106792380 | A | 5/2017 |
| CN | 206506707 | U | 9/2017 |
| CN | 109040921 | A | 12/2018 |
| DE | 102014218427 | A1 | 3/2016 |
| EP | 0735795 | A3 | 7/2003 |
| KR | 20020065419 | A | 8/2002 |

OTHER PUBLICATIONS

First Chinese Office Action for related Application No. 201810834802.0; dated Dec. 4, 2019.

Second Chinese Office Action for related Application No. 201810834802.0; dated Aug. 26, 2020.

Extended European Search Report for related Application No. 19840112.7; dated Aug. 18, 2021.

First Korean Office Action related to Application No. 10-2021-7005680 dated Mar. 30, 2022.

* cited by examiner

SOUND EMITTING STRUCTURE AND TERMINAL

CROSS REFERENCE TO RELATED APPLICATIONS

This application is a continuation application of PCT Application No. PCT/CN2019/096734 filed on Jul. 19, 2019, which claims priority to Chinese Patent Application No. 201810834802.0 filed in China on Jul. 26, 2018, which is incorporated herein by reference in its entirety.

TECHNICAL FIELD

Embodiments of the present disclosure relate to the field of communications technologies, and in particular, to a sound emitting structure and a terminal.

BACKGROUND

In the related art, a telephone receiver of a dual-screen terminal is mainly disposed in two manners. In a first manner, one home screen is disposed, and then a telephone receiver is disposed on a side corresponding to the home screen, for a user to use. In a second manner, both screens are disposed as home screens, and then telephone receivers are separately disposed, for a user to use. However, in the first manner, the user needs to perform a function of the telephone receiver only on the side of the home screen. As a result, each time the user uses the telephone receiver, the user needs to first flip to the side of the home screen. In the second manner, two telephone receivers are disposed. Although the screen does not need to be flipped during usage, arrangement space of the two telephone receivers needs to be occupied to dispose the two telephone receivers. This affects space for mounting another functional component.

As can be seen, in the related art, disposing of the double telephone receivers occupies excessively large space.

SUMMARY

Embodiments of the present disclosure provide a sound emitting structure and a terminal, to resolve the related-art problem that disposing of double telephone receivers occupies excessively large space.

An embodiment of the present disclosure provides a sound emitting structure, including:

a frame, where the frame includes an accommodation cavity, and the accommodation cavity includes a first opening and a second opening that are provided on two opposite sides of the frame;

a magnetic circuit system, where the magnetic circuit system is disposed inside the accommodation cavity, and the magnetic circuit system includes a first channel and a second channel;

a first diaphragm, where the first diaphragm is disposed opposite to the first opening, a voice coil is disposed on the first diaphragm, and the voice coil partially extends into the first channel; and a second diaphragm, where the second diaphragm is disposed opposite to the second opening, and the second channel is connected the first opening and the second opening.

An embodiment of the present disclosure further provides a terminal, including the foregoing sound emitting structure.

In the embodiments of the present disclosure, the sound emitting structure includes: a frame, where the frame includes an accommodation cavity, and the accommodation cavity includes a first opening and a second opening that are provided on two opposite sides of the frame; a magnetic circuit system, where the magnetic circuit system is disposed inside the accommodation cavity, and the magnetic circuit system includes a first channel and a second channel; a first diaphragm, where the first diaphragm is disposed opposite to the first opening, a voice coil is disposed on the first diaphragm, and the voice coil partially extends into the first channel; and a second diaphragm, where the second diaphragm is disposed opposite to the second opening, and the second channel is connected the first opening and the second opening. In this way, the sound emitting structure that can emit sound on both sides is disposed, so that the space occupied by the sound emitting structure in the terminal can be effectively reduced.

BRIEF DESCRIPTION OF DRAWINGS

To describe the technical solutions in the embodiments of the present disclosure more clearly, the following briefly describes the accompanying drawings required for describing the embodiments of the present disclosure. Apparently, the accompanying drawings in the following description show merely some embodiments of the present disclosure, and a person of ordinary skill in the art may derive other accompanying drawings from these accompanying drawings without creative efforts.

DESCRIPTION OF EMBODIMENTS

The following clearly and completely describes the technical solutions in the embodiments of the present disclosure with reference to the accompanying drawings in the embodiments of the present disclosure. Apparently, the described embodiments are some rather than all of the embodiments of the present disclosure. All other embodiments obtained by a person of ordinary skill in the art based on the embodiments of the present disclosure without creative efforts shall fall within the protection scope of the present disclosure.

Figure 1:
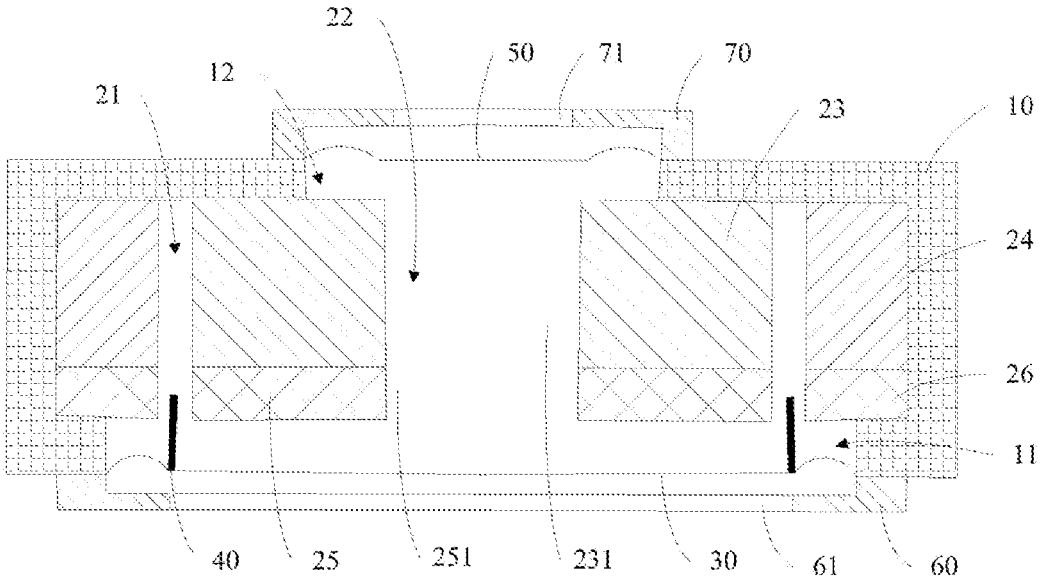
FIG. 1 is a schematic structural diagram 1 of a sound emitting structure according to an embodiment of the present disclosure.
Figure 2:
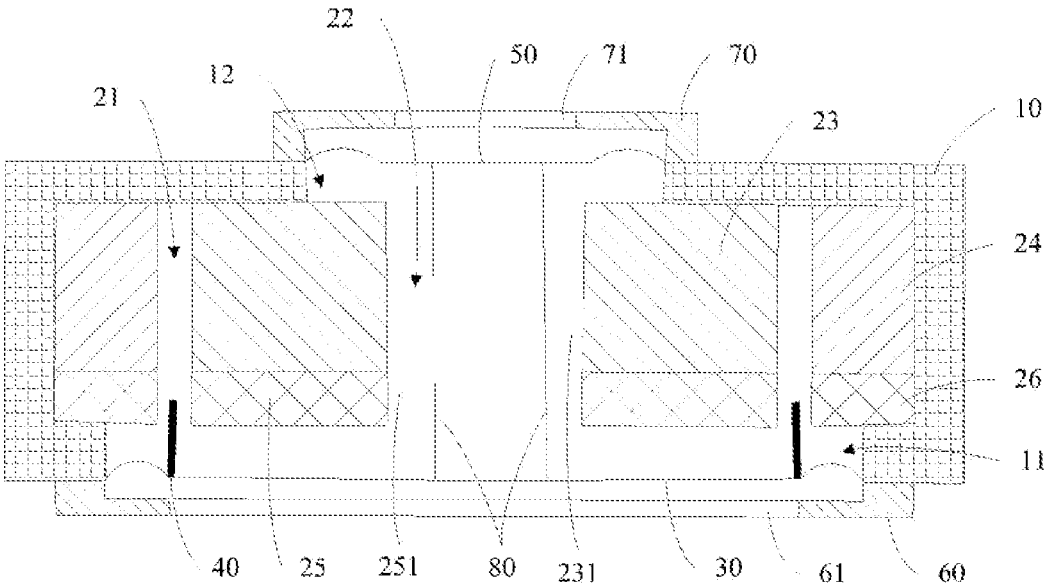
FIG. 2 is a schematic structural diagram 2 of a sound emitting structure according to an embodiment of the present disclosure.

As shown in FIG. 1 and FIG. 2, embodiments of the present disclosure provide a sound emitting structure, including:

a frame 10, where the frame 10 includes an accommodation cavity, and the accommodation cavity includes a first opening 11 and a second opening 12 that are provided on two opposite sides of the frame 10;

a magnetic circuit system, where the magnetic circuit system is disposed inside the accommodation cavity, and the magnetic circuit system includes a first channel 21 and a second channel 22;

a first diaphragm 30, where the first diaphragm 30 is disposed opposite to the first opening 11, a voice coil 40 is disposed on the first diaphragm 30, and the voice coil 40 partially extends into the first channel 21; and a second diaphragm 50, where the second diaphragm 50 is disposed opposite to the second opening 12, and the second channel 22 is connected the first opening 11 and the second opening 12.

In this implementation, the first diaphragm 30 is disposed at the first opening 11, and the second diaphragm 50 is disposed at the second opening 12, where the first opening 11 and the second opening 12 are provided on the two opposite sides of the frame 10. The first diaphragm 30 may be bonded with the voice coil 40, so that the first diaphragm 30 may vibrate along with the voice coil 40. Because a closed-loop magnetic field is formed in the first channel 21, when an electric signal passes through the voice coil 40 that is partially inside the first channel 21, the voice coil 40 that is partially inside the first channel 21 vibrates under the effect of the magnetic field loop, to drive the first diaphragm 30 to vibrate and emit sound. Vibration of the first diaphragm 30 drives airflow in the accommodation cavity to fluctuate, and the fluctuating airflow may be directed to the second diaphragm 50 through the second channel 22, so that the second diaphragm 50 vibrates along with the first diaphragm 30. Therefore, two opposite sides of the sound emitting structure can both emit sound.

The sound emitting structure may be a telephone receiver or a speaker, and its size and model may be designed according to an actual requirement. This is not limited herein.

Moreover, the second diaphragm 50 is disposed on a side of the second opening 12, so that the waterproof performance of the sound emitting structure can be improved.

In this way, for the terminal that needs to emit sound on both sides, the sound emitting structure that can emit sound on both sides is disposed, so that the terminal can emit sound on both sides. Compared with the related art in which telephone receivers or speakers need to be disposed on both front and rear sides of the terminal, this can effectively resolve the problem that disposing of the double telephone receivers or the double speakers occupies excessively large space.

The first channel 21 has a magnetic field loop. In this way, when an electrical signal passes through the voice coil 40, the voice coil 40 vibrates under the effect of the magnetic field loop. The second channel 22 is an airflow channel, so that the airflow generated when the first diaphragm 30 vibrates fluctuates and is directed to the second diaphragm 50. In this way, the second diaphragm 50 vibrates along with the first diaphragm 30, and the single voice coil achieves the effect of emitting sound on both sides.

The frame 10 is a support structure of the entire sound emitting structure, and may be formed through injection molding with a plastic material. A heat dissipation and ventilation hole may be provided on the side wall of the frame 10 to dissipate heat from the magnetic circuit system and the voice coil 40. This avoids overheating of the voice coil 40 and the magnetic circuit system when the sound emitting structure works.

Optionally, the magnetic circuit system includes a first magnet 23 and a second magnet 24, the second magnet 24 is disposed around the periphery of the first magnet 23, and there is a gap between the first magnet 23 and the second magnet 24 to form the first channel 21; and the first magnet 23 is provided with a first through hole 231 connecting the first opening 11 and the second opening 12, to form the second channel 22.

In this implementation, the first magnet 23 is connected to an inner wall on a side of the second opening 12 of the accommodation cavity, so that the first magnet 23 is fastened in the accommodation cavity. The second magnet 24 is attached to an inner side wall between the first opening 11 and the second opening 12 of the accommodation cavity, so that the second magnet 24 is fastened in the accommodation cavity.

The second magnet 24 may be formed integrally or by combining multiple sub-magnets. For the second magnet 24 formed integrally, an accommodation slot needs to be provided to accommodate the first magnet 23. For the second magnet 24 formed by combining multiple sub-magnets, the first magnet 23 needs to be surrounded, so that the gap between the first magnet 23 and the second magnet 24 forms the first channel 21.

It should be noted that the second magnet 24 in this implementation may also be replaced by an object with magnetic conductivity as long as the performance of the voice coil 40 can be achieved.

Magnetic poles of the first magnet 23 and the second magnet 24 have opposite directions, so that the gap between the first magnet 23 and the second magnet 24 may form a magnetic field loop and form the first channel 21. The voice coil 40 that is partially inside the first channel 21 can vibrate under the effect of an electric signal and the magnetic field loop, to drive the first diaphragm 30 to emit sound.

The first through hole 231 may be provided in the middle of the first magnet 23, or in a position on the left or right side of the middle of the first magnet 23, as long as the second diaphragm 50 can vibrate along with the first diaphragm 30. Optionally, to improve the accuracy of vibration of the second diaphragm 50 along with the first diaphragm 30 and improve the sound emitting effect of the second diaphragm 50, the first through hole 231 is provided in the middle of the first magnet 23.

To further improve the sound emitting effect of the second diaphragm 50, a linkage rod 80 may be disposed between the first diaphragm 30 and the second diaphragm 50, so that vibration frequencies of the second diaphragm 50 and the first diaphragm 30 are consistent. The linkage rod 80 may be made of a light and hard material with a good property of bonding with the first diaphragm 30 and the second diaphragm 50, for example, a carbon fiber material or a polymer plastic material. The linkage rod 80 is disposed, so that the first diaphragm 30 and the second diaphragm 50 may be equivalent to a whole, and the sound emitting structure has the same sound emitting effect on both front and rear sides. To improve the linkage effect of the first diaphragm 30 and the second diaphragm 50, multiple linkage rods 80 may be disposed between the first diaphragm 30 and the second diaphragm 50, and two linkage rods 80 may be selected.

In addition, the magnetic circuit system may further include a first magnetic conductive sheet 25 and a second magnetic conductive sheet 26, the first magnetic conductive sheet 25 is disposed in correspondence with the first magnet 23, the first magnetic conductive sheet 25 is provided with a second through hole 251 corresponding to the first through hole 231, and the second magnetic conductive sheet 26 is disposed in correspondence with the second magnet 24. The first magnetic conductive sheet 25 is disposed on a side that is of the first magnet 23 and that faces the first diaphragm 30, and the second magnetic conductive sheet 26 is disposed on a side that is of the second magnet 24 and that faces the first diaphragm 30. The first magnetic conductive sheet 25 and the second magnetic conductive sheet 26 are disposed, so that the magnetic flux density in the first channel 21 can be improved and the vibration effect of the voice coil 40 can be improved.

Optionally, the sound emitting structure further includes a first cover body 60 and a second cover body 70;

the first cover body 60 covers the first opening 11, the first diaphragm 30 is located between the first cover body 60 and the accommodation cavity, and the first cover body 60 is provided with a first sound outlet 61 corresponding to the first diaphragm 30; and the second cover body 70 covers the second opening 12, the second diaphragm 50 is located between the second cover body 70 and the accommodation cavity, and the second cover body 70 is provided with a second sound outlet 71 corresponding to the second diaphragm 50.

In this implementation, the first cover body 60 and the second cover body 70 are disposed, so that the first diaphragm 30 and the second diaphragm 50 can be protected, and the damage caused by foreign objects on the first diaphragm 30 and the second diaphragm 50 can be reduced. Moreover, in the application of the entire system, the first cover body 60 and the second cover body 70 may be mounted on and in contact with the entire system.

Moreover, to further protect the first diaphragm 30 and the second diaphragm 50, a first protective net may be further provided in the first sound outlet 61, the first protective net may also play a dust-proof function to prevent dust from covering the first diaphragm 30 and then affecting the sound emitting effect of the first diaphragm 30, the second protective net may be further provided at the second sound outlet 71, and the second protective net may also play a dust-proof function to prevent dust from covering the second diaphragm 50 and then affecting the sound emitting effect of the second diaphragm 50.

It should be noted that the structural shape of each part of the sound emitting structure may be designed according to an actual requirement. For example, when the frame 10 is a cube structure, the first cover body 60 and the second cover body 70 may be provided in a square shape. When the frame 10 is a cylinder structure, the first cover body 60 and the second cover body 70 may be provided in a circular shape. The structural shapes of other components may also be provided according to actual situations, as long as the sound emitting structure can emit sound on double sides.

An embodiment of the present disclosure further relates to a terminal, including the foregoing sound emitting structure.

Optionally, the terminal is a dual-screen terminal, for example, a double-screen terminal or a foldable-screen terminal.

The terminal may also be a mobile phone, a tablet computer, a personal digital assistant (Personal Digital Assistant, PDA), an e-book reader, a moving picture experts group audio layer III (Moving Picture Experts Group Audio Layer III, MP3) player, a moving picture experts group audio layer IV (Moving Picture Experts Group Audio layer IV, MP4) player, a laptop portable computer, an in-vehicle computer, a desktop computer, a set top box, a smart TV, a wearable device, and the like.

It should be noted that the implementation of the embodiment of the foregoing sound emitting structure is also applicable to the embodiment of the terminal, and the same technical effect can be achieved. This is not repeated herein.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

The invention claimed is:

1. A sound emitting structure, comprising:

a frame, wherein the frame comprises an accommodation cavity, and the accommodation cavity comprises a first opening and a second opening that are provided on two opposite sides of the frame;

a magnetic circuit system, wherein the magnetic circuit system is disposed inside the accommodation cavity, and the magnetic circuit system comprises a first channel and a second channel;

a first diaphragm, wherein the first diaphragm is disposed opposite to the first opening, a voice coil is disposed on the first diaphragm, and the voice coil partially extends into the first channel; and a second diaphragm, wherein the second diaphragm is disposed opposite to the second opening, and the second channel is connected the first opening and the second opening;

wherein the magnetic circuit system comprises a first magnet and a second magnet, the second magnet is disposed around the periphery of the first magnet, and there is a gap between the first magnet and the second magnet to form the first channel; and the first magnet is provided with a first through hole connected the first opening and the second opening, to form the second channel;

wherein the magnetic circuit system further comprises a first magnetic conducive sheet and a second magnetic conductive sheet, the first magnetic conductive sheet is disposed on a side that is of the first magnet and that faces the first diaphragm, the first magnetic conductive sheet is provided with a second through hole corresponding to the first through hole, and the second magnetic conductive sheet is disposed on a side that is of the second magnet and that faces the first diaphragm.

2. The sound emitting structure according to claim 1, wherein the first through hole is a through hole provided in the middle of the first magnet.

3. The sound emitting structure according to claim 1, wherein the sound emitting structure further comprises a linkage rod inside the second channel, and two ends of the linkage rod are separately connected to the first diaphragm and the second diaphragm.

4. The sound emitting structure according to claim 3, wherein the linkage rod is made of a carbon fiber material or a polymer plastic material.

5. The sound emitting structure according to claim 1, wherein the sound emitting structure further comprises a first cover body and a second cover body;

the first cover body covers the first opening, the first diaphragm is located between the first cover body and the accommodation cavity, and the first cover body is provided with a first sound outlet corresponding to the first diaphragm; and the second cover body covers the second opening, the second diaphragm is located between the second cover body and the accommodation cavity, and the second cover body is provided with a second sound outlet corresponding to the second diaphragm.

6. The sound emitting structure according to claim 5, wherein the first sound outlet is provided with a first protective net, and the second sound outlet is provided with a second protective net.

7. A terminal, comprising the sound emitting structure according to claim 1.

8. The terminal according to claim 7, wherein the terminal is a dual-screen terminal.

* * * * *